US005121586A

United States Patent [19]

Focke

[11] Patent Number: 5,121,586

[45] Date of Patent: Jun. 16, 1992

[54] APPARATUS FOR ATTACHING AN ADHESIVE TAPE TO A FOLDING CARTON OR THE LIKE

[75] Inventor: Heinz Focke, Verden, Fed. Rep. of Germany

[73] Assignee: Focke & Co., (GmbH & Co), Verden, Fed. Rep. of Germany

[21] Appl. No.: 606,290

[22] Filed: Oct. 31, 1990

[30] Foreign Application Priority Data

Nov. 18, 1989 [DE] Fed. Rep. of Germany ..... 3938410

[51] Int. Cl.[5] ..... B65B 51/06

[52] U.S. Cl. ..... 53/136.4; 53/389.3; 53/389.4

[58] Field of Search ..... 53/136.4, 415, 389.4, 53/589.2, 389.3; 156/468, 522

[56] References Cited

U.S. PATENT DOCUMENTS 4,061,526 12/1977 Warshaw ..... 156/468 X
4,738,075 4/1988 Marchetti ..... 53/136.4
4,889,581 12/1989 Ulrich ..... 53/136.4 X

FOREIGN PATENT DOCUMENTS 237535 4/1964 Austria .
193626 9/1986 European Pat. Off. .
1561923 4/1970 Fed. Rep. of Germany .
1511685 11/1970 Fed. Rep. of Germany .
2100890 7/1976 Fed. Rep. of Germany .
3236702 2/1984 Fed. Rep. of Germany .

*Primary Examiner*—John Sipos
*Attorney, Agent, or Firm*—Sughrue, Mion, Zinn, Macpeak & Seas

[57] ABSTRACT

Adhesive tapes 10 are automatically attached to closing sides 12 of folding cartons 11 which the cartons are transported. An adhesive tape 10 is pulled off a reel and pressed onto a folding carton under tension by means of pressure rollers. A pressure roller 26 presses an end leg 39 of the adhesive tape 10, which is projecting from the folding carton 11 at a rear side thereof, against a transversely directed side face 40 of the folding carton 11. When an adhesive tape 10 made of unstable carrier material are used, there is a danger of the tape creasing or curling up, especially at end portions thereof. To overcome this problem, a smoothing device in the form of a stationary suction head 41 is provided. The adhesive tape 10 slides along this smoothing device, such that at the final stage, the projecting end leg 39 is temporarily held in smooth and straight position until it is taken over by the pressure roller 26.

3 Claims, 6 Drawing Sheets

APPARATUS FOR ATTACHING AN ADHESIVE TAPE TO A FOLDING CARTON OR THE LIKE

BACKGROUND OF THE INVENTION

The invention relates to an apparatus for attaching an adhesive tape to a folding carton or the like in order to close said carton, the adhesive tape being under longitudinal tension, pressed onto said carton along a closing side thereof by means of a pressure means (pressure roller) as a result of relative movement.

Adhesive tapes for closing folded cartons or other packs are usually made of synthetic material and are coated with an adhesive on one side. With (large-volume) folding cartons, adhesive tapes are affixed in the region of a closing side or two oppositely situated closing sides, such that outer folding flaps are connected to one another by means of the adhesive tape. Normally, end legs of the adhesive tape extend into the region of transverse carton side faces adjoining the closing sides, where they are adhesively bonded.

The adhesive tapes are affixed to the folding carton by means of automatically operating taping units. The adhesive tape is pulled off a reel, guided over deflecting rollers and finally pressed onto the folding carton by means of a pressure means (pressure roller). Normally, the taping unit is mounted stationary, whereas the folding cartons are conveyed past the taping unit to receive the adhesive tape. Such a taping unit is for instance disclosed in U.S. Pat. No. 4,238,269.

In practice, the carrier tapes of such adhesive tapes used to be made of PVC. Lately, adhesive tapes made of other synthetic materials such as polypropylene tend to be used more and more. This material however is difficult to work with. In particular, the longitudinal tension in the tape causes it to crease and curl up when it is attached to the folding carton. Undesired deformations in the free end portion of the adhesive tape, especially in its end leg, occur especially after the tape section assigned to the folding carton is cut off.

SUMMARY OF THE INVENTION

Setting out from this problem, the invention has the object to propose measures which make it possible to perfectly and faultlessly process even those adhesive tapes which have a carrier tape made of less dimensionally stable material, such as polypropylene. It shall be particularly ruled out that the tape creases or that its end portions curl up.

In order to attain this object the apparatus as taught by the invention is characterized in that the adhesive tape, while being attached to the folding carton, is guided and straightened by a smoothing means.

The smoothing means can be designed to work mechanically. In the preferred embodiment of the invention, the smoothing means operates with a vacuum and consists of a suction head or suction plate along which the adhesive tape runs or slides along during the press-on process. As a result of the holding force (originating from the vacuum) applied across the full width of the adhesive tape, the latter can not fold or crease.

The smoothing means of the invention is particularly effective at the end portion of a tape section assigned to a folding carton, i.e. after said tape section has been cut off the continuous web of adhesive tape. A severing cut is applied such that a portion of the adhesive tape projects from the closing side of the carton, specifically with an end leg which is to be folded over in the transverse direction. This freely projecting end leg is kept smooth and uncreased by the smoothing means, i.e. the suction head, while the carton is transported further. Directly downstream of the smoothing means, a pressure means, namely a pressure roller, takes effect by pressing the end leg onto the respective carton face.

Further features of the invention relate to the arrangement and design of the smoothing means, especially its position relative to the pressure means.

BRIEF DESCRIPTION OF THE DRAWINGS

In the following, a preferred embodiment of the invention will be described in more detail with reference to the drawings, in which.

DESCRIPTION OF A PREFERRED EMBODIMENT

Figure 1:
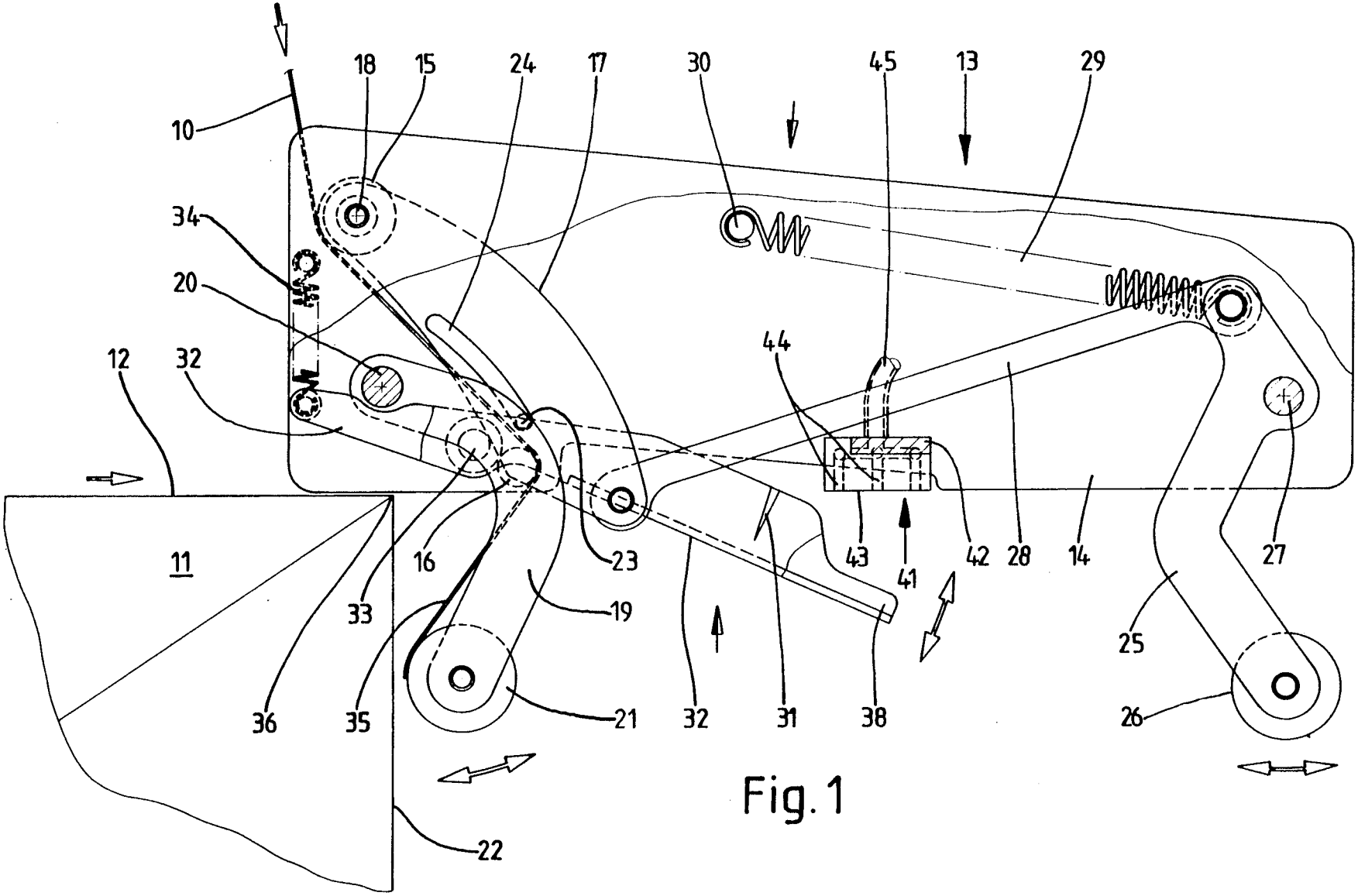
FIG. 1 is a side view of a taping unit at the start of the process of attaching an adhesive tape.

The embodiment shown in the drawings relates to attaching an adhesive tape 10 to a container, namely a folding carton 11. This carton 11 is for example designed such that outer folding flaps on oppositely situated sides, namely closing sides 12, are connected to one another by the adhesive tape 10. For attaching the adhesive tape 10, the folding carton 11 is transported relative to a stationary taping unit. The closing sides 12 can be directed laterally or alternatively such that they face to the top and bottom. One embodiment of such a taping station is subject matter of DE-OS 38 16 856.

In the taping station, a taping unit 13 is assigned to each closing side 12. In the embodiment of the taping unit shown in the drawings, movable means are mounted on a frame plate 14 which is located directly next to the path of motion of the folding carton 11, its closing side 12 facing towards the taping unit 13.

The adhesive tape 10, being pulled off a reel (not shown), runs over a first deflecting roller 15 and then over a second deflecting roller 16. The adhesive tape 10 abuts the periphery of the second deflecting roller 16 with its adhesive face. Both deflecting rollers are pivoted on a supporting piece 17 which is pivotally or tiltably connected with the frame plate 14. A pivot bearing 18 of the supporting piece 17 is arranged equiaxially to the first deflecting roller 15.

A first front pressure lever 19 is also pivoted on the frame plate 14. The pivot bearing 20 of this pressure lever 19 is disposed at a distance from the pivot bearing 18, nearer to the path of motion of the folding carton 11. The pressure lever 19 has a curved or angular shape. At the free end of the pressure roller 19, there is located a first front pressure roller 21. The adhesive tape 10 runs from the second deflecting roller 16 to the periphery of the pressure roller 21, such that the adhesive face is outwardly directed and faces towards a carton side face 22 which is pointing ahead.

The pressure lever 19 is geared with the supporting piece 17. For this purpose, a sliding journal 23 is disposed laterally on the pressure lever, said sliding journal 23 entering a slightly curved guiding slot 24 of the supporting piece 17. When the pressure lever 19 pivots, the supporting piece 17 is also actuated in a pivoting manner.

A second pressure lever 25 is disposed at a distance from the pressure lever 19 on the frame plate 14. At the free end of the also angular-shaped pressure lever 25, there is located a rear second pressure roller 26.

The pressure lever 25 is designed as a two-armed lever and is pivotable about a pivot bearing 27. The free end of the pressure lever 25 which is directed away from the pressure roller 26 is geared with the supporting piece 17 via a guide rod 28. As a result, pivoting movements of the supporting piece 17 effect pivoting movements of the pressure lever 25.

The above-described means are loaded in the starting position as shown in FIG. 1. In the present case they are loaded by a tension spring 29, one end of which being connected to the frame plate 14 with a supporting crosspiece 30 and the other end being connected to the free end of the pressure lever 25. As a result of the geared connection, the restoring forces of the tension spring 29 also reach the supporting piece 17 and the pressure lever 19.

Figure 3:
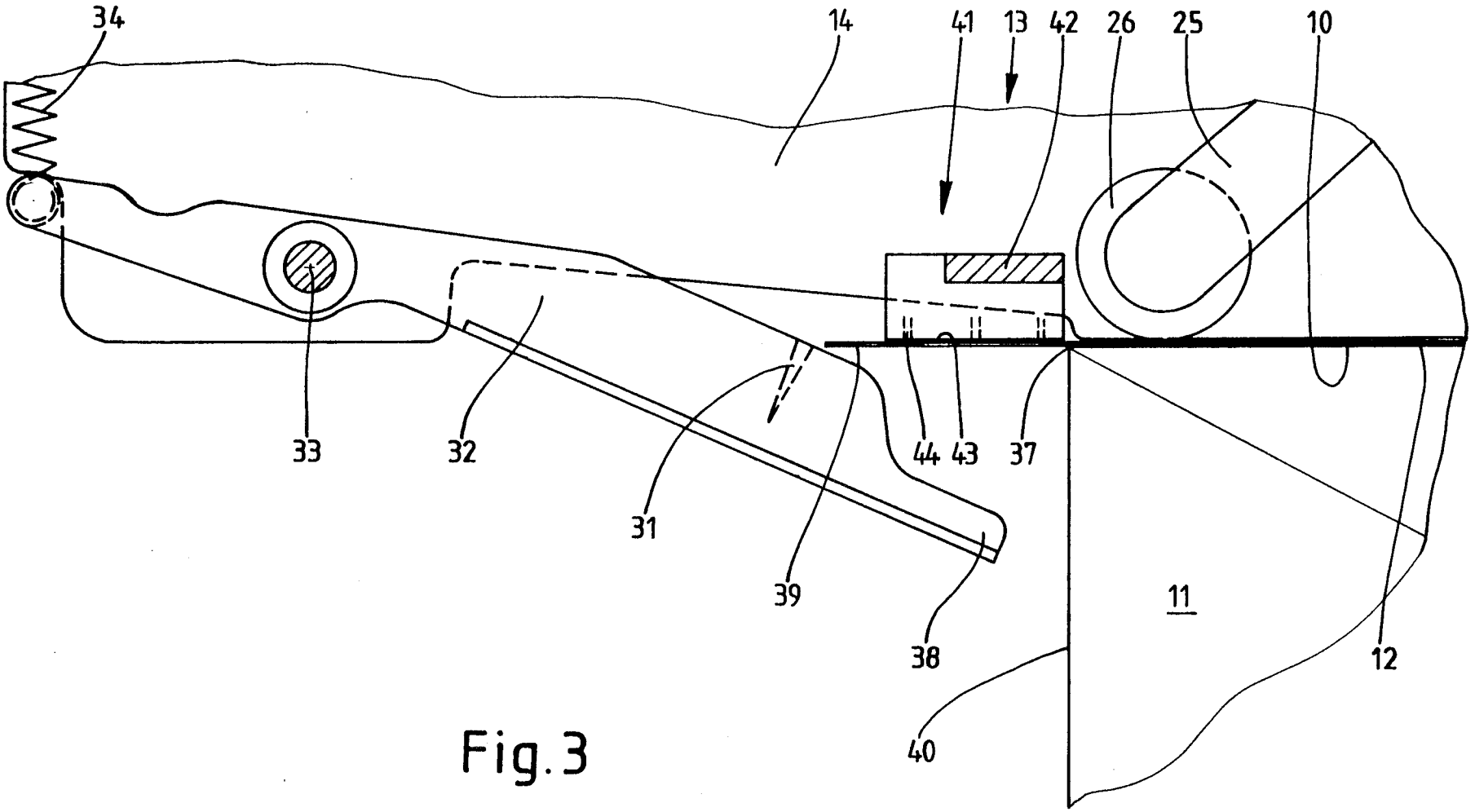
FIG. 3 shows an enlarged detail of the unit according to FIGS. 1 and 2 at the final stage of the process of affixing an adhesive tape.

Furthermore, there is a severing means arranged on the frame plate 14, specifically a severing knife 31 arranged transverse relative to the adhesive tape 10. In the present embodiment, this severing knife 31 is located on a knife arm 32 which is designed as a two-armed lever and which has a pivot bearing 33 at an edge of the frame plate 14 which is facing towards the path of motion of the folding carton 11. The free end of the knife arm 32 is loaded by a restoring spring 34 into a starting position as shown in FIG. 3 in which the portion of the knife arm with the severing knife 31 extends into the path of motion of the folding carton 11.

Figure 5:
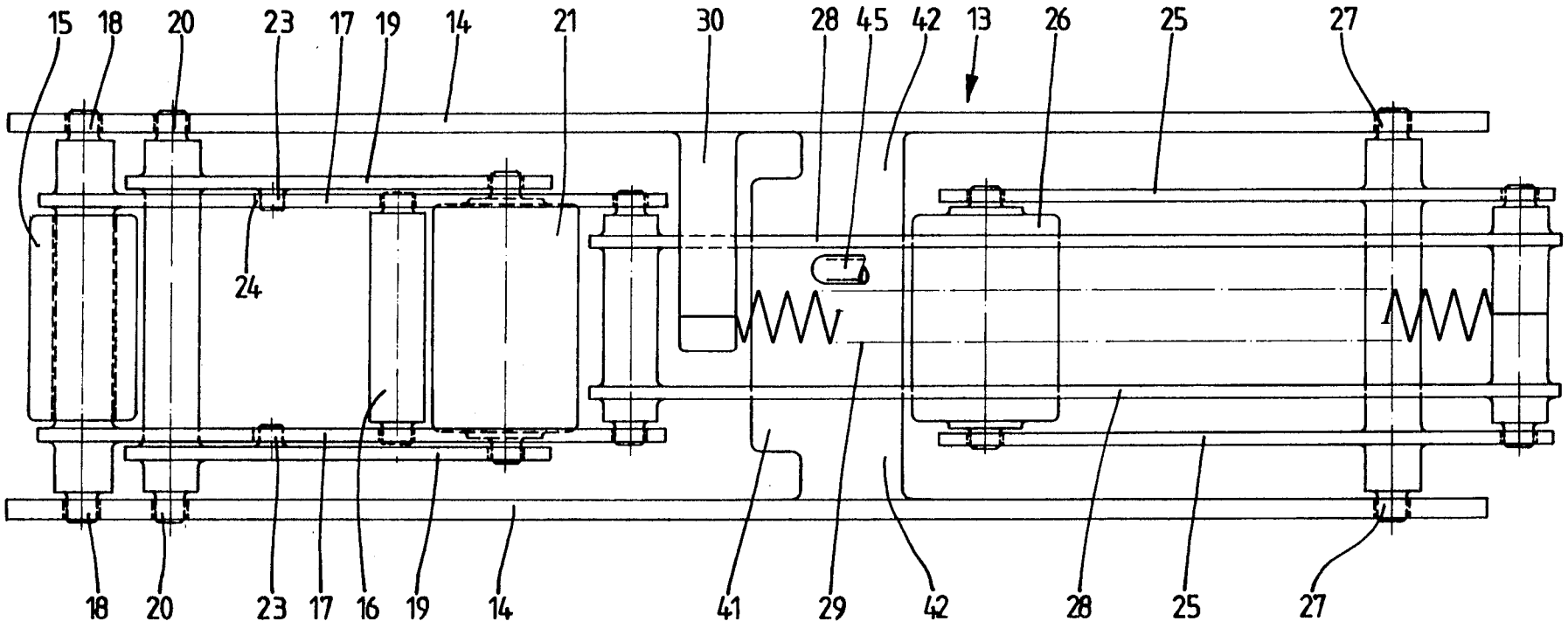
FIG. 5 is a plan view of the taping unit in a position according to FIG. 2.
Figure 6:
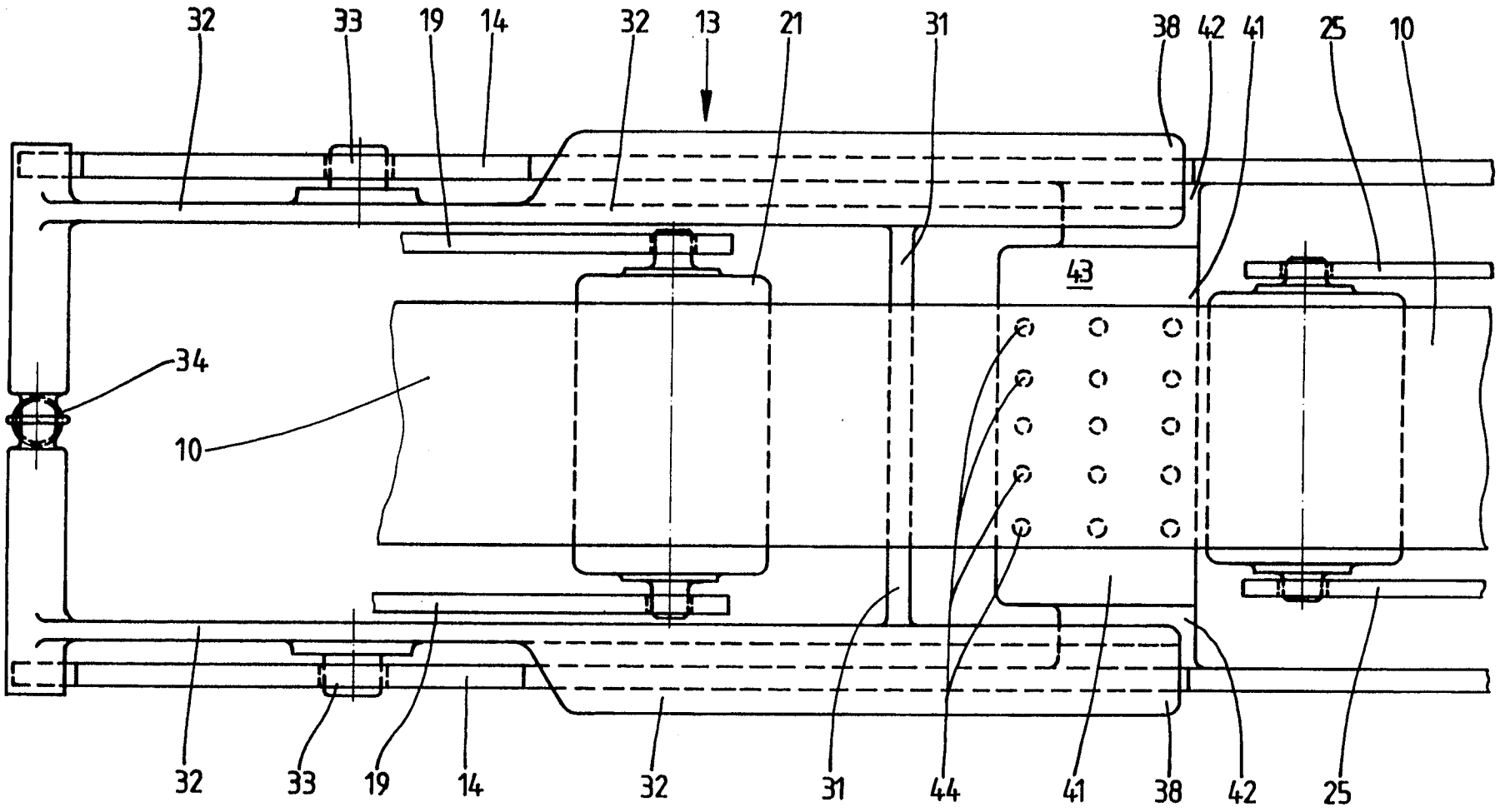
FIG. 6 is a bottom view of details of the taping unit.

As shown in FIGS. 5 and 6, the supporting means for the above-described rollers and the severing knife 31 are provided in pairs, the rollers being laterally pivoted with respective pivot journals on the levers, that is to say on the two frame plates 14 which are spaced apart. The two supporting pieces 17 which are spaced apart from one another, the pressure levers 19 and 25 as well as the knife arms 32 are firmly connected to each other by transversely directed axle shafts. At the ends of these axle shafts there are disposed the pivot journals for the pivot bearings.

The above-described taping unit 13 operates such that a free end of the adhesive tape 10 is pressed against the front side face 22 (position as shown in FIG. 1) of the carton by the pressure roller 21 which is extending into the path of motion of the folding carton 11. As the continuously conveyed folding carton 11 moves further, the pressure lever 19 is pivoted anticlockwise and an end leg 35 of the adhesive tape 10 is pressed against the front side face 22 of the folding carton 11.

In the further pivoting movement of the pressure lever 19, the pressure roller 21, across a carton edge 36, reaches the region of the carton closing side 12 extending in the conveying direction. During this movement, adhesive tape 10 is kept being pulled off the reel by the folding carton 11 which is continuously moving on. As a result of the position of the adhesive tape 10 relative to the pressure roller 19, the adhesive tape is now also pressed against the carton in the region of the closing side 12 (position as shown in FIG. 2).

Figure 2:
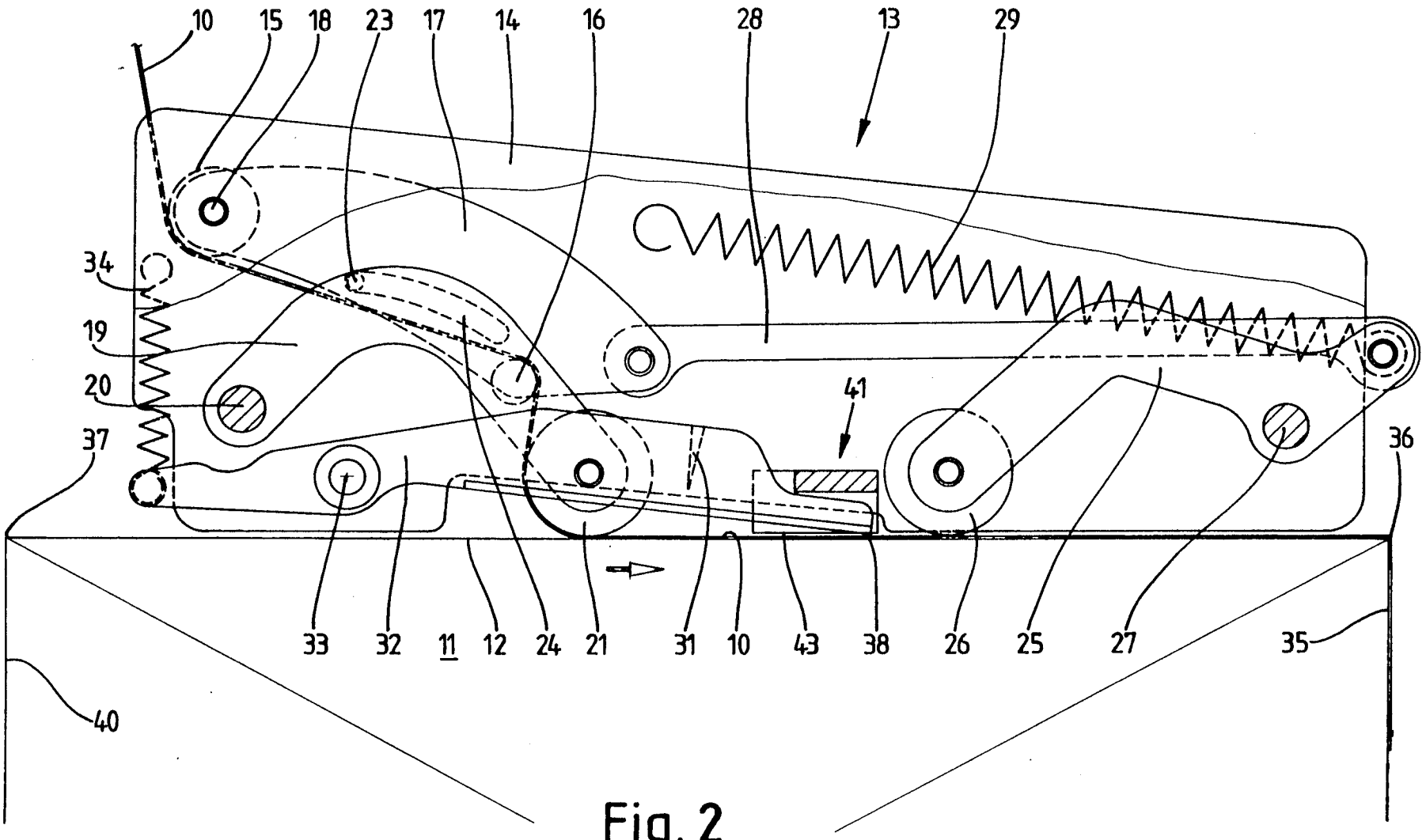
FIG. 2 shows the unit according to FIG. 1 in a different position relative to a folding carton.

While the pressure lever 19 pivots out of the path of motion of the folding carton 11 the supporting piece 17 is also pivoted, namely into the position as shown in FIG. 2. The guide rod 28 causes the pressure lever 25 to pivot clockwise, such that the pressure roller 26 arranged on the rear pressure lever 25 also leaves the path of motion of the folding carton 11. Now, the pressure roller 26 also runs along the closing side 12, specifically in the region of the adhesive tape 10.

When the front pressure roller 21 is moved across a rear carton edge 37 and leaves the region of the folding carton 11, the relative position as shown in FIG. 2 remains unchanged for a while. The adhesive tape is conveyed further and forms a portion which is projecting from the rear side of the folding carton 11 and which is under longitudinal tension.

As a result of the relative movement between folding carton 11 and taping unit 13, the knife arm 32 is also pushed out of the path of motion of the folding carton 11, such that the restoring spring 34 is stressed and a free end of the knife arm 32 also abuts the closing side 12 and slides along the same. As soon as this free support end 38 of the knife arm 32 slides across the carton edge 37 it loses its support so that the knife arm 32 (as a result of the forces of the restoring spring 34) pivots. In this process, the severing knive 31 with its blade crosses the plane of the free adhesive tape and severs the same. The relative position has been chosen such that in this cutting process a rear end leg 39 of the adhesive tape 10 is formed which projects from the closing side 12.

In the further course of movements, the pressure roller 26 is also moved across the rear carton edge 37 and therewith engages the projecting end leg 39 and presses it against a rear side face 40 of the folding carton.

When adhesive tapes 10 having a carrier layer of unstable material such as polypropylene are used, there is the risk of deformations and creases and a curling up of the tape, especially in the region of end leg 39. This danger is caused by the (longitudinal) tension which occurs when the adhesive tape 10 is pulled off a reel.

In order to guarantee that the adhesive tape, including the end legs 35 and 39, is pressed on the folding carton smoothely and without any creases, a smoothing means is assigned to the taping unit 13. In the present embodiment, this smoothing means consists of a platelike suction head 41 which is a platelike body being arranged with supporting crosspieces 42 in a stationary relative position between the frame plates 14. The suction head 41 is located in the region of the path of motion of the adhesive tape 10, such that said tape is moved along a holding surface 43 of the suction head 41 in a sliding manner. The adhesive-free side of the adhesive tape 10 abuts the holding surface 43.

In order to affix the adhesive tape 10 in a smooth manner without any creases, the holding surface 43 is loaded with a vacuum. A plurality of suction bores 44 open out into the holding surface 43. In the present embodiment, there are several, specifically three rows of suction bores 44 arranged side by side in the direction of the adhesive tape 10 and distributed across the full width of the adhesive tape 10 which as a result is held across the full width by the vacuum. The suction bores of suction head 41 are connected to a vacuum source via a common piping 45.

Figure 4:
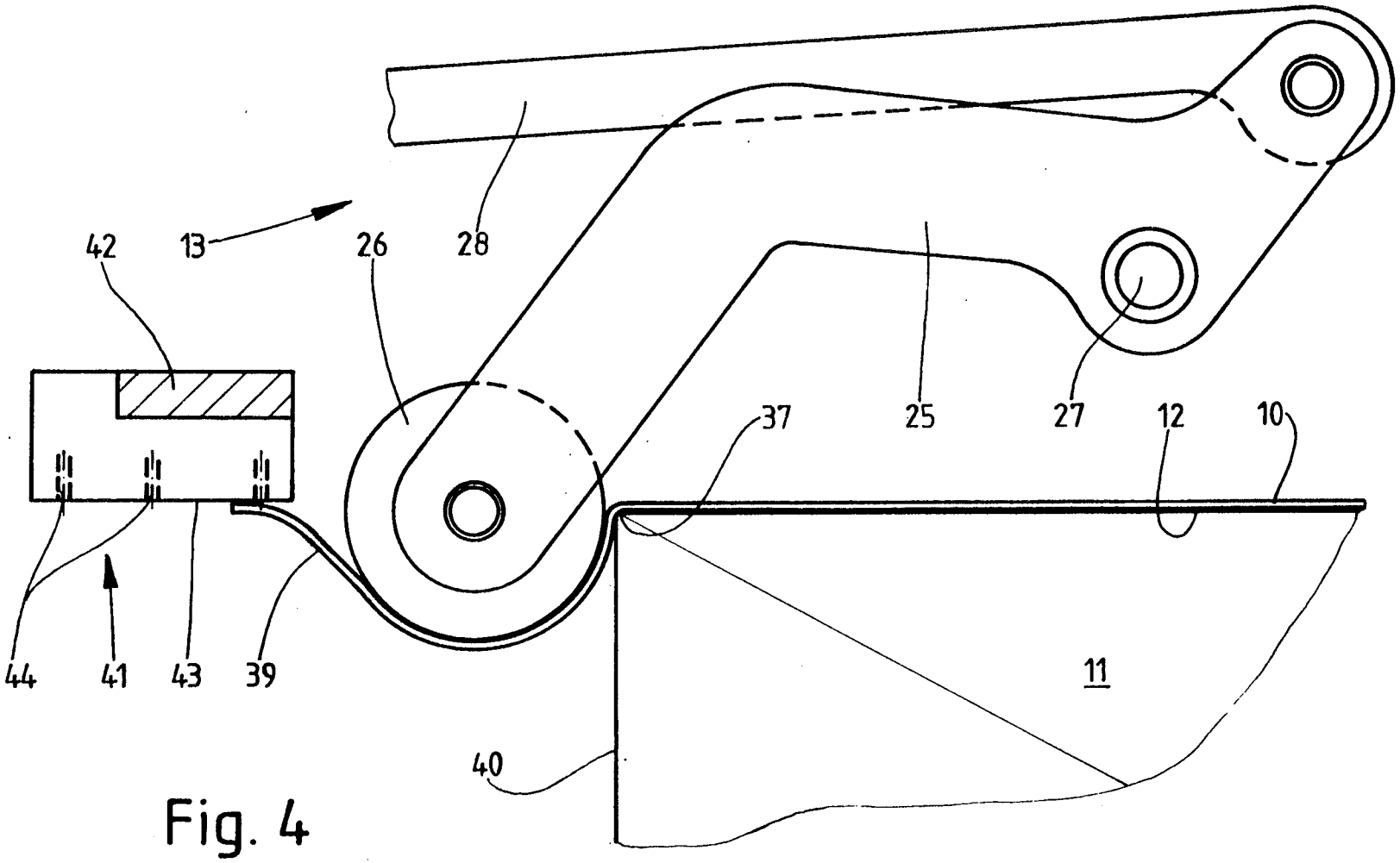
FIG. 4 shows means of the unit on an even larger scale at an even further advanced stage of the process of affixing the adhesive tape.

The suction head 41 in its function as a smoothing means is particularly effective at the final stage of pressing on the adhesive tape 10 (FIGS. 3 and 4). The end leg 39 projecting from the folding carton 11 at the rear end is held by the suction head 41 in stretched-out and smooth-surfaced position until the end leg 39 is taken over by the pressure roller 26. As shown in FIG. 4, the free end of the adhesive tape 10 is fixed to the holding surface 43 until the very last moment and is thus kept from curling up or deforming in any other way.

The suction head 41 is arranged in a special relative position on the taping unit 13, namely in the conveying direction of the folding carton 11 at a small distance behind the pressure roller 26 for the end leg 39. This relative position ensures that the freely projecting end leg 39 is held by the holding surface 43 until it nearly completely abuts the peripheral surface of the pressure roller.

The distance between suction head 41 and severing knife 31 is defined such that the suction head 41 is located in the region of the end legs when the adhesive tape 10 is severed (FIG. 3). As a result, the end leg 39 is never left unsupported and is always held by a means in spread-out and uncreased form.

A smoothing means for the adhesive strip 10, especially a suction head 41 as described above, can also be employed in taping units which are designed in a different way, for instance in an apparatus as disclosed in U.S. Pat. No. 4,238,269.

What is claimed is:

1. In an apparatus for attaching an elongated adhesive tape (10) to a moving folding carton (11) in order to close said carton (11) having a top horizontal face and a vertical rear side face, wherein the adhesive tape (10) is severed across its width from a continuous web and is pressed onto the folding carton (11) along a closing seam of the carton by a pressure roller (26), wherein an end leg (39) of the tape (10), which is formed when the adhesive tape (10), is severed by a severing knife (31), is pressed against a rear side face (40) of the folding carton (11) by said pressure roller (26), and wherein said apparatus includes a suction head (41), located ahead of said pressure roller (26) in the direction of movement for temporarily holding the end leg (39) extending beyond the top face of the carton, the improvement wherein said suction head (41) has a plate-like design and has several suction bores (44) which are arranged in a planar holding surface (43) of said head in spaced relationship in both longitudinal and transverse directions of said suction head and also across the entire width of the adhesive tape (10) for slidingly holding said end leg until it is substantially completely abuts the peripheral surface of the pressure roller (26) so that the adhesive tape (10) slides along the holding surface (43) in a slipping manner when the tape (10) is pressed against the carton's rear side face (40) by said pressure roller (26).

2. The apparatus as claimed in claim 1, wherein the suction bores (44) of the suction head (41) are connected to a common pipe (45) which, in turn, is connected to a vacuum source.

3. The apparatus as claimed in claim 2, wherein said suction head (41) is part of a taping unit (13), and wherein the suction head (41) is connected to lateral frame plates (14) of the taping unit (13) with transversely directed supporting crosspieces (42).

* * * * *